US011486196B2

(12) United States Patent
Huang et al.

(10) Patent No.: US 11,486,196 B2
(45) Date of Patent: Nov. 1, 2022

(54) CURTAIN HANGING ASSEMBLY

(71) Applicants: Hsien-Te Huang, Taipei (TW); Yu-Wei Huang, Taipei (TW)

(72) Inventors: Hsien-Te Huang, Taipei (TW); Yu-Wei Huang, Taipei (TW)

( * ) Notice: Subject to any disclaimer, the term of this patent is extended or adjusted under 35 U.S.C. 154(b) by 0 days.

(21) Appl. No.: 17/169,897

(22) Filed: Feb. 8, 2021

(65) Prior Publication Data

US 2021/0363821 A1 Nov. 25, 2021

(30) Foreign Application Priority Data

May 19, 2020 (TW) ..... 109206262

(51) Int. Cl.

| | |
|---|---|
| ***E06B 9/70*** | (2006.01) |
| ***E06B 9/42*** | (2006.01) |
| ***E06B 9/58*** | (2006.01) |
| *E06B 9/66* | (2006.01) |

(52) U.S. Cl.

CPC ..... *E06B 9/70* (2013.01); *E06B 9/42* (2013.01); *E06B 9/58* (2013.01); *E06B 9/66* (2013.01); *E06B 2009/583* (2013.01)

(58) Field of Classification Search

CPC ..... E06B 9/70; E06B 9/42; E06B 9/58; E06B 9/66; E06B 2009/583; E06B 9/327; E06B 9/322; E06B 9/60; E06B 2009/2625; E06B 9/262; A47H 5/02; A47H 5/032

USPC ..... 160/310

See application file for complete search history.

(56) References Cited

U.S. PATENT DOCUMENTS

| | | | | |
|---|---|---|---|---|
| 7,143,802 | B2 * | 12/2006 | Strand | E06B 9/60 160/167 R |
| 7,832,450 | B2 * | 11/2010 | Brace | E06B 9/262 160/84.05 |
| 8,573,281 | B2 * | 11/2013 | Drew | E06B 9/262 160/84.05 |
| 9,004,139 | B2 * | 4/2015 | Wu | E06B 9/38 160/167 R |
| 9,314,125 | B2 * | 4/2016 | Anthony | E06B 9/322 |
| 9,441,417 | B2 * | 9/2016 | Shih | E06B 9/262 |
| 9,732,555 | B2 * | 8/2017 | Morris | E06B 9/322 |
| 9,759,008 | B2 * | 9/2017 | Anderson | E06B 9/388 |
| 9,765,565 | B2 * | 9/2017 | Morris | E06B 9/262 |
| 9,797,188 | B2 * | 10/2017 | Rettig | E06B 9/262 |
| 10,036,200 | B2 * | 7/2018 | Anderson | E06B 9/262 |
| 10,584,528 | B2 * | 3/2020 | Anderson | E06B 9/17007 |
| 11,002,069 | B2 * | 5/2021 | Dekker | E06B 9/322 |
| 11,091,955 | B2 * | 8/2021 | Anderson | E06B 9/327 |
| 2008/0121350 | A1 * | 5/2008 | Cheng | E06B 9/322 160/170 |
| 2008/0142169 | A1 * | 6/2008 | Dekker | E06B 9/322 160/188 |
| 2009/0014133 | A1 * | 1/2009 | Lin | E06B 9/262 160/181 |

(Continued)

*Primary Examiner* — Beth A Stephan

(74) *Attorney, Agent, or Firm* — Muncy, Geissler, Olds & Lowe, P.C.

(57) ABSTRACT

A curtain hanging assembly that consists of a curtain assembly able to effect horizontal opening and closing of curtains, and includes two elastic motor units provided with elastic feedback. Interactive dynamics between the two elastic motor units, through linear linkage, respectively cause torque forces produced to be in mutual opposition, enabling the let down area of the curtains to be naturally fixed at any height position.

14 Claims, 7 Drawing Sheets

(56) References Cited

U.S. PATENT DOCUMENTS

| | | | | |
|---|---|---|---|---|
| 2011/0005690 | A1* | 1/2011 | Harding | E06B 9/262<br>160/84.03 |
| 2012/0227912 | A1* | 9/2012 | Anderson | E06B 9/32<br>160/370 |
| 2012/0312486 | A1* | 12/2012 | Spray | E06B 9/388<br>24/115 L |
| 2013/0087296 | A1* | 4/2013 | Mullet | E06B 9/262<br>160/405 |
| 2013/0340949 | A1* | 12/2013 | Anderson | E06B 9/322<br>160/84.02 |
| 2015/0020980 | A1* | 1/2015 | Franssen | E06B 9/382<br>160/84.01 |
| 2018/0155983 | A1* | 6/2018 | Franssen | E06B 9/42 |
| 2018/0347267 | A1* | 12/2018 | Dekker | E06B 9/322 |

* cited by examiner

CURTAIN HANGING ASSEMBLY

BACKGROUND OF THE INVENTION

(a) Field of the Invention

A curtain hanging assembly, which consists of a curtain assembly able to effect horizontal opening and closing of curtains, and includes two elastic motor units provided with elastic feedback that can respectively produce equal opposing torque forces, enabling the let down area of the curtains to be naturally fixed at any position.

(b) Description of the Prior Art

In order to safeguard the safety of children, recent curtain assemblies have discarded the pull cords used to pull up and let down a window shade 12 (as shown in FIG. 1). The structure enables a user to grab a lower rail 14 with their hand to cause upward and downward displacement of the window 12 to adjust the covering area (height of the window shade 12) of a window. The power required to take up the window shade 12 uses a roll up driving force of an elastic feedback unit 16 stored with elastic feedback energy positioned on an upper rail 11. While pulling down the window shade 12, the tension in the main body of the window shade 12 drives the elastic feedback unit 16 to rotate, and during the rotation process, an elastic reaction on an elastic feedback element 13, configured in the interior of the elastic feedback unit 16, causes an accumulation of energy therein. The elastic feedback force (torque) produced by the elastic feedback unit 16 produces a torque curve C, shown in FIG. 2, and the elastic reaction of the torque curve C upwardly rises as a deformation amount L increases. And as shown in FIG. 1, when the user's hand applies force on the lower rail 14 to force the window shade 12 down to its lowest position, stored energy in the elastic feedback produced by the elastic feedback unit 16 is maximum, causing the elastic feedback unit 16 to correspondingly produce the maximum pulling force on the lower rail 14.

SUMMARY OF THE INVENTION

The primary object of a curtain hanging assembly lies in providing a curtain assembly able to effect horizontal opening and closing of curtains, and includes two elastic motor units provided with elastic feedback that can respectively produce opposing torque forces of equal intensity. The elastic motor units are respectively configured with a roll up and let down feedback unit and a take up and let down opposing unit, wherein the interactive dynamics between the two, through linear linkage, respectively cause the torque forces produced to be in mutual opposition, enabling the let down area of the curtains to be naturally fixed at any position.

Another objective of the present invention lies in the elastic motor units configured with the roll up and let down feedback unit and the take up and let down opposing unit, wherein the upper elastic motor unit enables additional load torque.

A third objective of the present invention lies in stored energy members used by the elastic motor units being helical springs, or elastic metal sheets that are formed as leaf springs by scrolling.

A fourth objective of the present invention lies in the curtains being window shades or slatted blinds, wherein the slatted blinds include venetian blinds, and are configured with an angular position adjuster able to adjust shade angle.

A fifth objective of the present invention lies in the curtains consisting of the window shade and slatted blinds indirectly joined through a horizontal lifting rod.

A sixth objective of the present invention lies in the roll up and let down feedback unit configured with the elastic motor unit or the take up and let down opposing unit is at least fitted with a pressure regulation device able to adjust initial torque.

A seventh objective of the present invention lies in the design of the present invention using an electronic signal system, with at least one elastic core component replaced by an electric motor.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
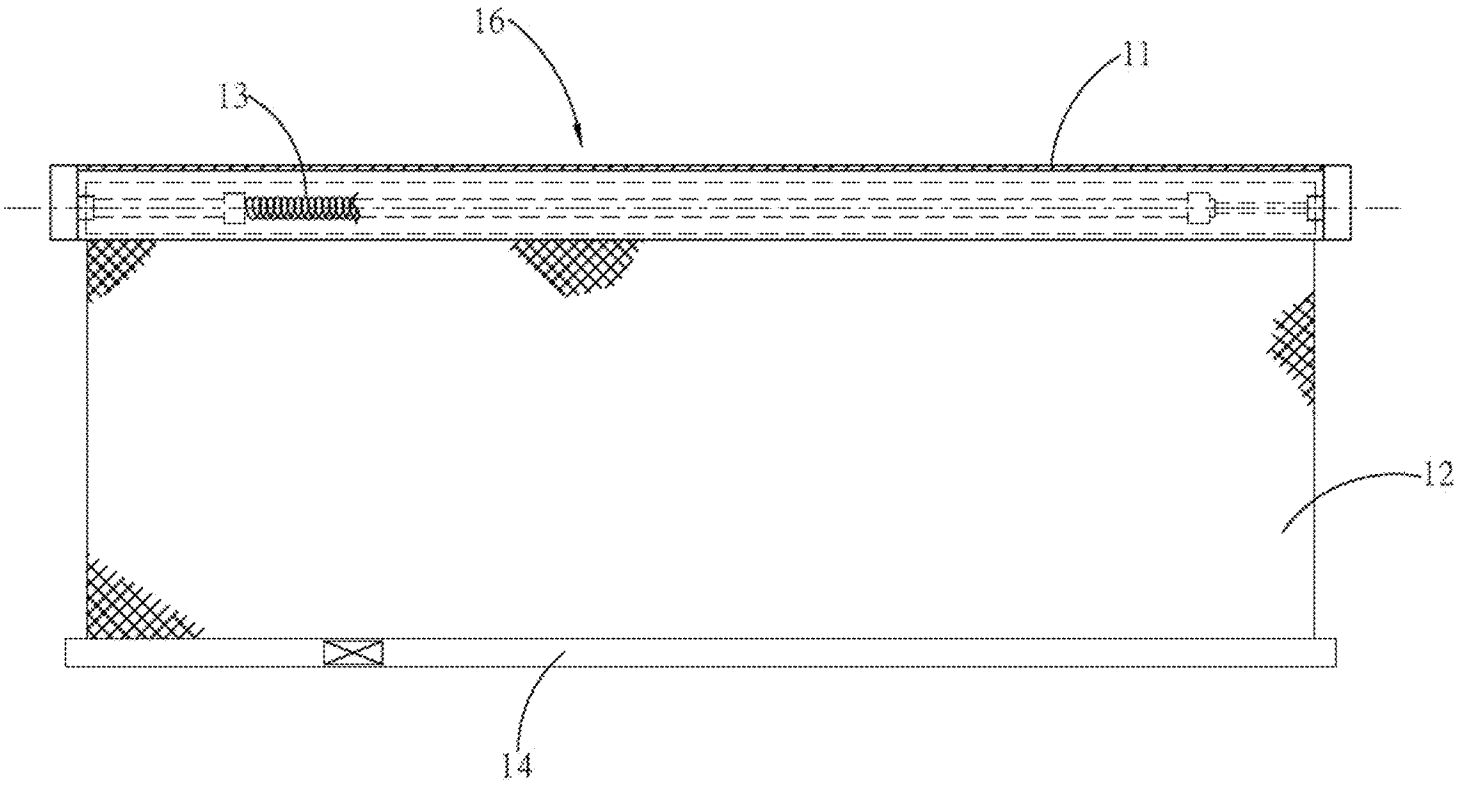
FIG.1 Prior Art
FIG. 1 is a structural schematic view of a curtain assembly of the prior art.
Figure 2:
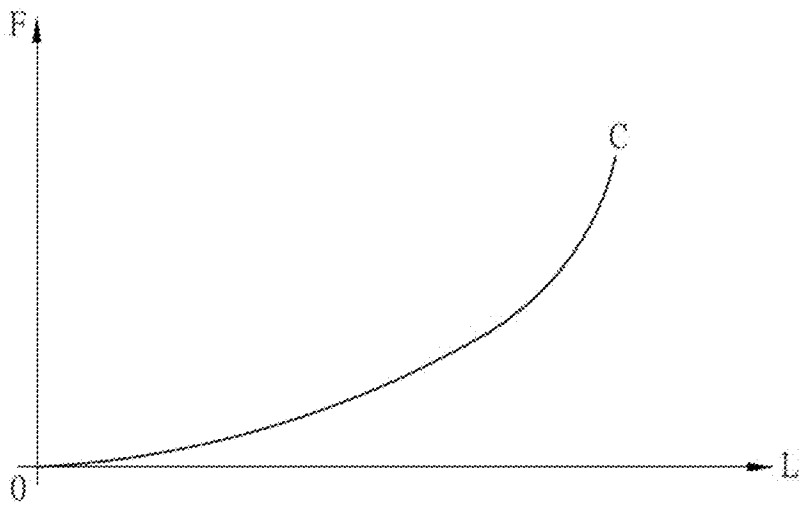
FIG. 2 Prior Art
FIG. 2 is a graph showing the feedback torque produced by the curtain assembly of the prior art.
Figure 3:
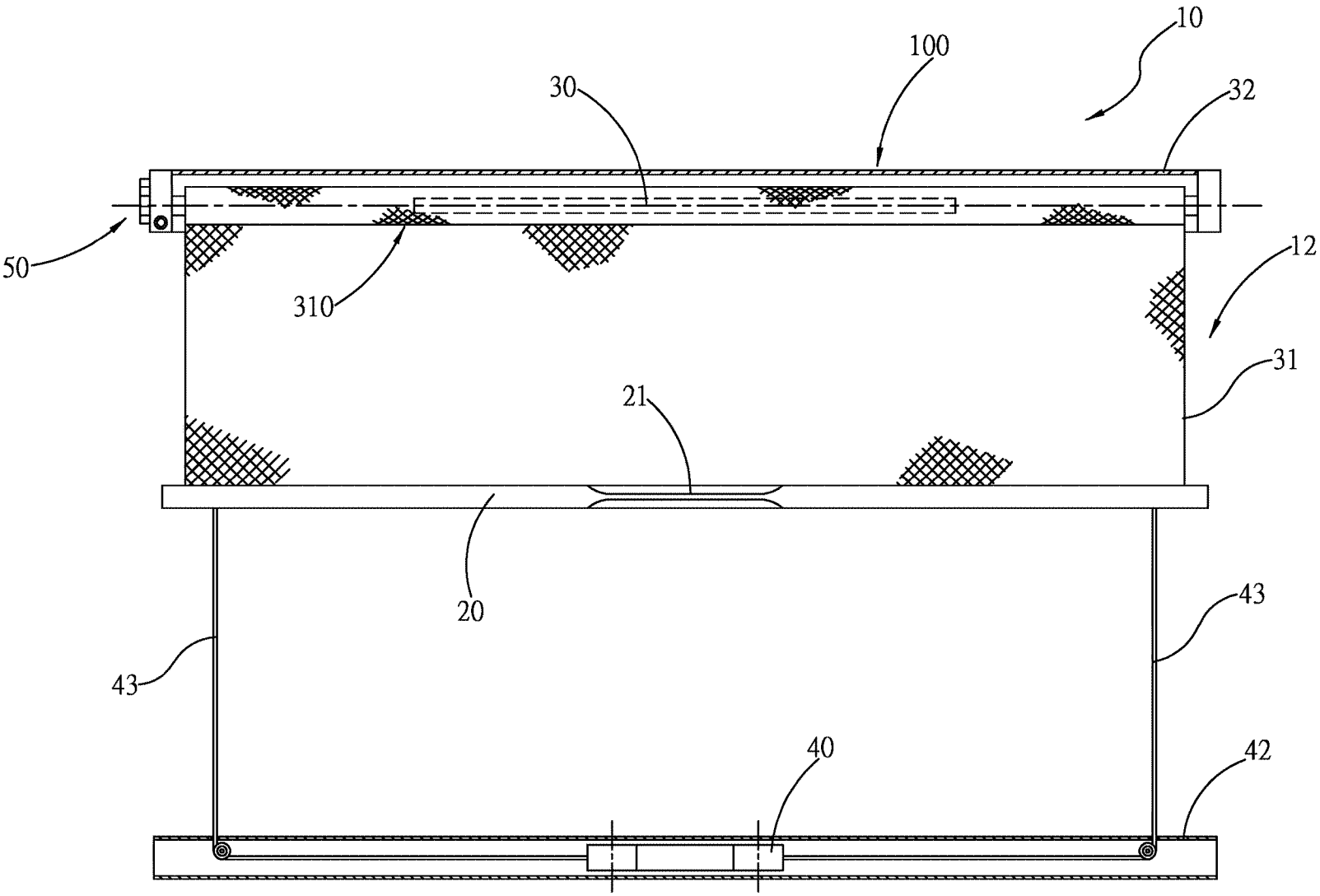
FIG. 3 shows a front view of the structure of a curtain hanging assembly of the present invention.

Regarding the embodiment modes of the present invention, please refer to the description of the diagrams as follows: Referring first to FIG. 3, in order to form the basis for torque opposition, an embodiment of the present invention is configured with two elastic motor units 100, which are respectively installed to the interior of the fixed rail 32 and an opposing fixed rail 42. One of the elastic motor units 100 is a roll up and let down feedback unit 30, and the other elastic motor unit 100 is a take up and let down opposing unit 40. The roll up and let down feedback unit 30 connectively drives the window shade 31, and the extremity of the 15 free end of the window shade 31 is joined to a horizontal lifting rod 20. The take up and let down opposing unit 40 is connectively linked to at least left and right linkage pull cords 43, which are joined to two sides of the horizontal lifting rod 20. A pressure regulation device 50 is fitted to the elastic motor unit 100 at the position of the roll up and let down 20 feedback unit 30, wherein the pressure regulation device 50 is used to adjust an initial elastic torque of the roll up and let down feedback unit 30 or function in concert with the torque curve produced by the take up and let down opposing unit 40. The pressure regulation device 50 uses a general inward elastic member (not shown in the drawings)

for angular position transformation, and is a general device able to modify the initial torque, thus not further detailed herein.

Regarding the above-described roll up and let down feedback unit 30 and the take up and let down opposing unit 40 which use elastic reactions provided thereby, the structures thereof are provided with center lines with either a metal twisted spring or a volute shaped metal leaf spring that enable generating rotary motion and function as the core components for the units' elastic accumulation energy and elastic feedback, whereby torque forces are produced during the feedback action.

The torque core components respectively associated with the roll up and let down feedback unit 30 and the take up and let down opposing unit 40 in the present embodiment can be the aforementioned simple spring structural members. If it is required to remotely operate the curtain system to cause the curtains to be in shading states, the torque core component configured in one of the units (i.e., a spring) can be replaced by an electric motor.

The torque producing component of either the roll up and let down feedback unit 30 or the take up and let down opposing unit 40 is either a helical spring or a volute spring, and functions as the core component for torque stored energy and feedback. And the volute spring can sequentially change the intensity of torque produced thereby.

A curtain 12 is a window shade, and the roll up and let down feedback unit 30 rolls up and lets down the window shade 31 using a rolling shaft method. A portion wound round the outer circumference of the roll up and let down feedback unit 30 is a fabric roll 310.

Figure 4:
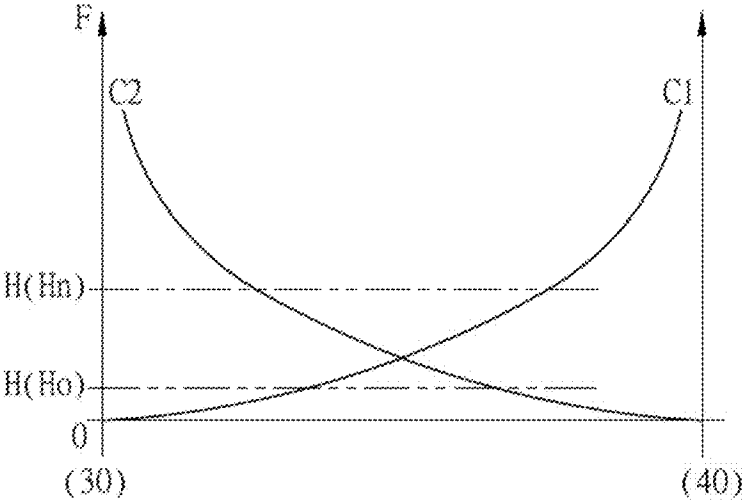
FIG. 4 shows a graph of opposing torque forces respectively produced by two elastic motor units of the present invention.

The elastic motor units 100 of the present invention are respectively configured with the roll up and let down feedback unit 30 and the take up and let down opposing unit 40, the two of which produce corresponding opposing curves (as shown in FIG. 4). The two torque curves produced by the roll up and let down feedback unit 30 and the take up and let down opposing unit 40, respectively, show strong and weak correspondence at any open length H position of the horizontal lifting rod 20. Hence, the horizontal lifting rod 20 is able to achieve a balance of torque forces at any open length H position. Regarding the operating state of mutual opposition, referring to FIG. 3, while the horizontal lifting rod 20 is being pulled down, the width tension of the window shade 31 connectively drives the elastic stored energy and torque reaction of the roll up and let down feedback unit 30, hence, the more a handle 21 is pulled downward the larger the stored energy and feedback force of the roll up and let down feedback unit 30, at which time, the take up and let down opposing unit 40 pulls up the horizontal lifting rod 20 by means of the linkage pull cords 43, and the pulling down force produced by the take up and let down opposing unit 40 correspondingly increases. On the contrary, if the handle 21 is raised upward, the shade area of the window shade 31 is reduced, then the feedback torque produced by the roll up and let down feedback unit 30 is correspondingly lessened. And because of the correspondence between the opposing torque intensities shown in the two torque curves of FIG. 4, the take up and let down opposing unit 40 on the pulling torque of the linkage pull cords 43 is correspondingly diminished. Further, because of the reciprocal opposition of the two curves, the torque forces of the roll up and let down feedback unit 30 and the take up and let down opposing unit 40 are correspondingly changeable. Hence, the handle 21 can be fixed at any position by receiving opposing torques.

In addition, with regard to the elastic feedback stress curve of the take up and let down opposing unit 40, in the system dynamics structure, if there exists the assistance of frictional resistance or the system configuration has a curtain counterweight member (not shown in the drawings), then the stress curve of the take up and let down opposing unit 40 can have an even force value.

The take up and let down opposing unit 40 can be formed as a volute shape by winding round and constructing curvatures in sheet metal, wherein, during the process of winding round and constructing, the curvatures can be individually adjusted to enable the elastic feedback produced by the take up and let down opposing unit 40 to respond according to the feedback torque configuration of the roll up and let down feedback unit 30, which enables the systemic horizontal lifting rod 20 to be naturally fixing at any height position.

Figure 5:
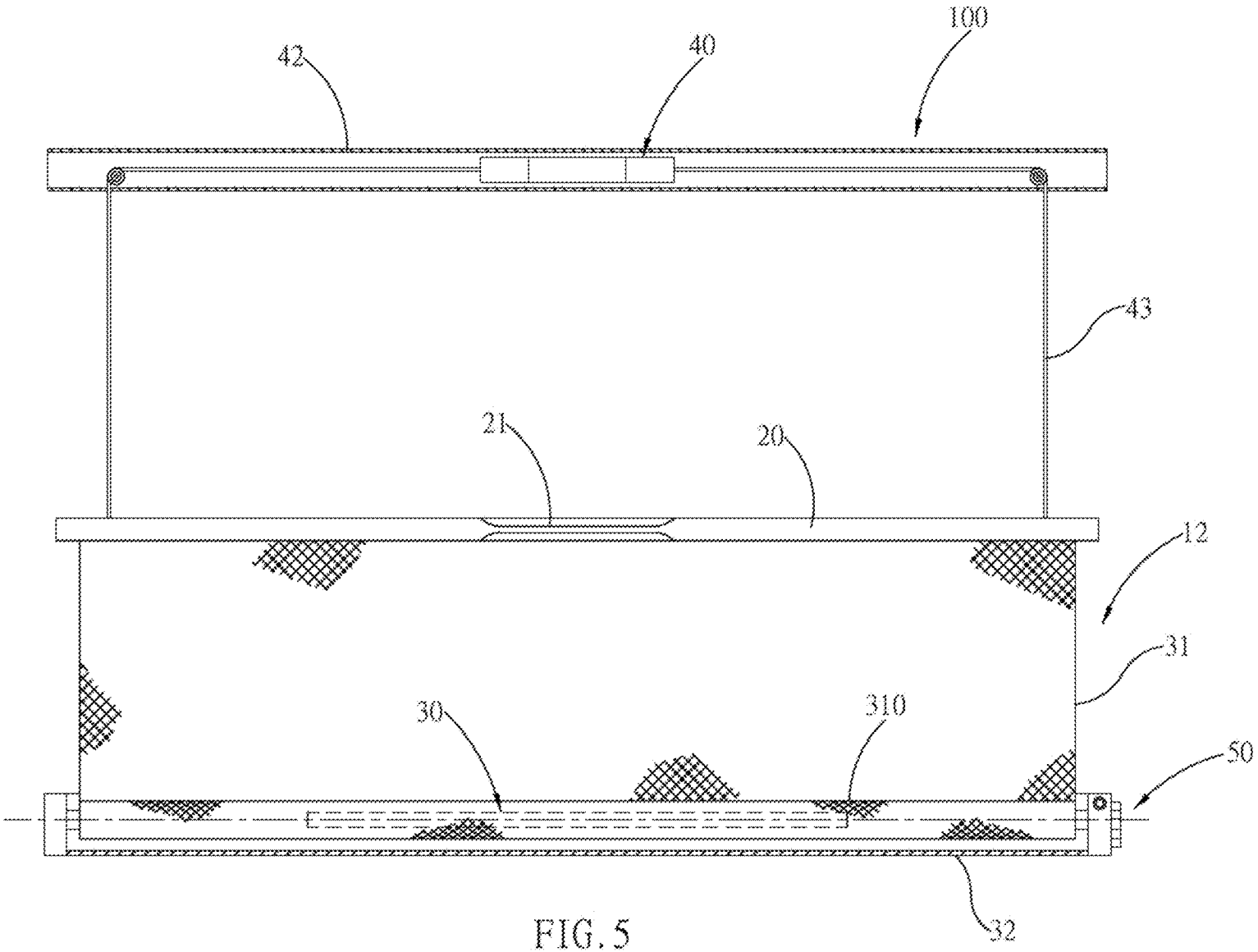
FIG. 5 shows a front view of another embodiment of the embodiment shown in FIG. 3 according to the present invention.

Referring to FIG. 5, which shows an embodiment configuration permutation of FIG. 3, wherein the take up and let down opposing unit 40 is configured to the upper elastic motor unit 100, and the roll up and let down feedback unit 30 is configured to the lower elastic motor unit 100. The curtain 12 connectively driven by the roll up and let down feedback unit 30 is the window shade 31, wherein the window shade 31 forms the fabric roll 310 after being subjected to the roll up and assemble of the roll up and let down feedback unit 30, the entire body of which is fixed to the lower edge of a window by way of the fixed rail 32. The take up and let down opposing unit 40 is fixed to the upper edge of a window by way of the opposing fixed rail 42, and the take up and let down opposing unit 40 connects to the horizontal lifting rod 20 by way of the linkage pull cords 43. The handle 21 is the basis for applying a force to operate pulling up and letting down the window shade 31. When a user raises the window shade 31 upward from its lowest position using 10 the handle 21, the area of the window shade 31 adjusts the shading height. This embodiment is especially suitable for a ground floor home or inside a room, specially a room with a slumber bed, by bringing about a sunlight blocking effect of the lower space, while the area of the upper space enables sunlight or air flow to enter. The take up and let down opposing unit 40 is used to raise the window shade 31, which enables changing the height position of the horizontal lifting rod 20 in the window area space. Similarly, the two opposing torques of the elastic motor units 100 enable the horizontal lifting rod 20 to be fixed at any height position.

Figure 6:
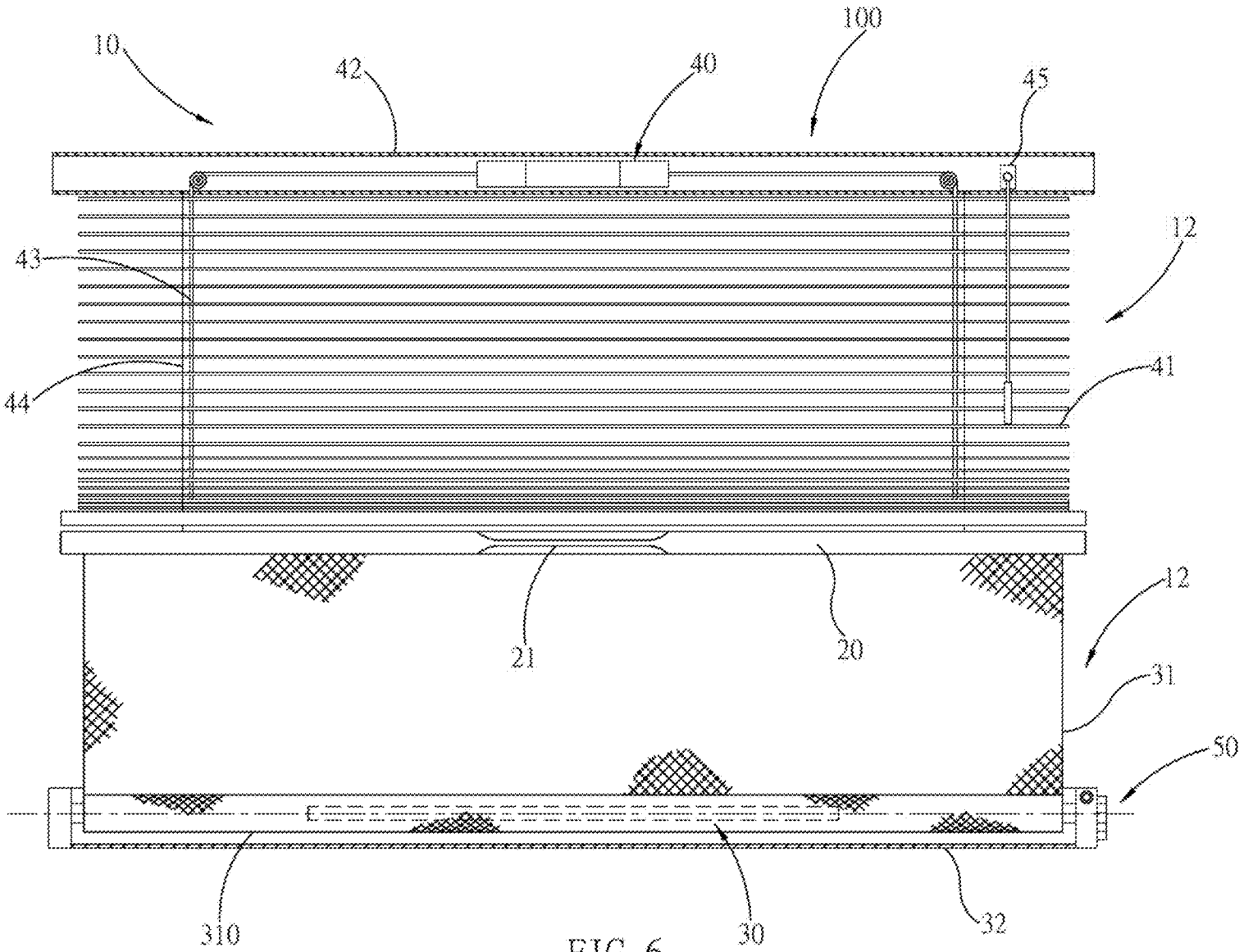
FIG. 6 shows another applied embodiment view of the curtain hanging assembly depicting curtains formed using slatted blinds combined with a window shade according to the present invention.

Referring to FIG. 6, which shows the curtains 12 configured in the curtain hanging assembly 10 of the present invention are the window shade 31 and the slatted blinds 41, which are indirectly interconnected by means of the horizontal lifting rod 20. The slatted blinds 41 can be venetian blinds or pleated shades. When the slatted blinds 41 are venetian blinds, then an angular position adjuster 45 is used to adjust shade angle, and the take up and let down opposing unit 40 controls the linkage pull cords 43. The tail end of the linkage pull cords 43 are joined to one side of the horizontal lifting rod 20, and the end side of the window shade 31 is joined to another side of the handle 21. The pulling force lines of the linkage pull cords 43 and the window shade 31 coincide.

The angular position adjuster 45 is used to adjust an angle changing ladder cord 44, which adjusts the shade angular position of the slats of the slatted blinds 41. The angular position adjuster 45 is a commonly used device, and thus not further detailed herein.

The window shade 31 is rolled up and assembled by means of the roll up and let down feedback unit 30, wherein the rolled up portion forms the fabric roll 310, the entire body of which is carried by the fixed rail 32 and fixed to a window frame. The take up and let down opposing unit 40 is fixed on the upper edge of a window frame by means of the opposing fixed rail 42, and the distance of the fixed rail 32 from the opposing fixed rail 42 enables the opposing torques produced by the elastic motor units 100 to pull the linkage pull cords 43 and the window shade 31 to form a linear tension effect therein. The horizontal lifting rod 20 is fitted with the handle 21, which enables the user to adjust the shade state of the curtain 12.

The window shade 31 can be a high density knitted fabric curtain, which provides a high performance sunlight blocking effect. If the curtain 12 is window blinds, then they can be opened to allow air to flow in and out or adjust the shading coefficient. When the horizontal lifting rod 20 is completely let down, then the slatted blinds 41 are completely opened, which allows partial or complete entry of sunlight, or partial or complete circulation of air flow. When the horizontal lifting rod 20 is raised to its highest position, then the window shade 31 can be used to completely block sunlight, The horizontal lifting rod 20 joined between the window shade 31 and the slatted blinds 41 is used to achieve multifunctional application of the curtain assembly, wherein the torque forces respectively produced by the take up and let down opposing unit 40 and the roll up and let down feedback unit 30, as shown in FIG. 4, oppose each other to enable naturally fixing the horizontal lifting rod 20 at any position.

Figure 7:
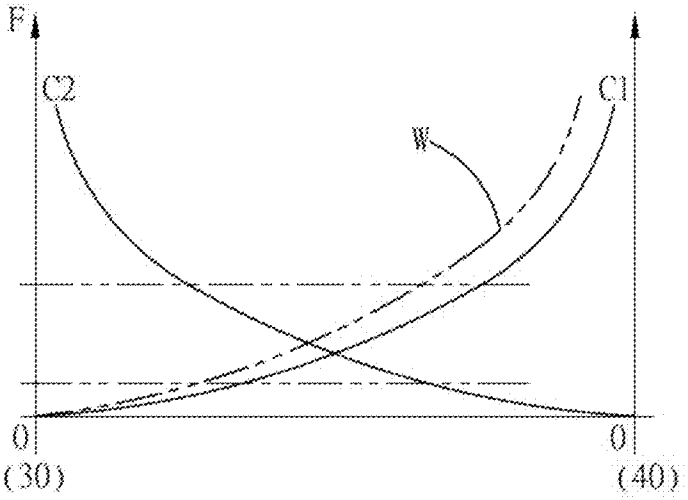
FIG. 7 shows a curve schematic view depicting the torque with additional load produced by one of the elastic motor units according to the present invention.

Referring to FIG. 7, which is based on FIG. 4, when the curtain 12 is let down to any height position, as shown in FIGS. 3, 5, and 6, the roll up and let down feedback unit 30 and the take up and let down opposing unit 40 produce opposing torque curves C1 and C2, respectively, that occur synchronously and with equal value. The two curves C1 and C2 shown are the basis for an intersecting distribution.

According to the embodiments shown in FIGS. 3, 5, and 6, the area amount of the curtain 12 at different lowered heights is different, thus, the gravity effect of the weight thereof is different. For example, in the configuration shown in FIG. 3, when the curtain 12 is let down to a certain height position, because it has been released from the roll structure binding force at the fabric roll 310 position, the area of the actual lowered curtain 12 forms a let-down lowered body weight which increases/decreases according to the lowered state of the curtain 12. The more the curtain 12 is let down, the greater the area of the lowered curtain 12, resulting in an increasing lowered body weight of the curtain 12. Hence, apart from needing to produce a reciprocal opposing torque force in the take up and let down opposing unit 40, the roll up and let down feedback unit 30 must further bear the increasing lowered body weight produced by the lowered curtain 12. Because the lower the curtain 12 is let down the greater the lowered body weight thereof, thus, the roll up and let down feedback unit 30 is provided with an increasing potential feedback torque, which must prepare to bear the increasing opposition of the accumulated weight produced by the lowered curtain 12. Accordingly, because the feedback torque of the roll up and let down feedback unit 30 must bear the load of the increasing lowered body weight of the curtain 12, an increasing load torque is added thereto that is reflected on the original torque curve C1 to form the resulting torque curve W.

Application of the above-described resulting torque curve W can be similarly configured in the embodiments shown in the FIGS. 5 and 6, with the resulting torque curve W responding according to the different upper/lower assembly position changes of the roll up and let down feedback unit 30 and the take up and let down opposing unit 40. And can also be additionally configured to reflect on the torque curve C2 of the take up and let down opposing unit 40.

The elastic motor units 100 proposed in this specification (as shown in FIGS. 3 to 7) can be indirectly controlled through an electronic signal to operate the curtain system, wherein a power core component used by at least either the roll up and let down feedback unit 30 or the take up and let down opposing unit 40 is replaced by an electric motor (not shown in the drawings). The torque produced by the electric motor is adjusted to correspond with the power curve of the replaced power core component.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A curtain hanging assembly, comprising:

a roll up and let down feedback unit;

a fixed rail horizontally fixed, in which roll up and let down feedback unit is installed;

a horizontal roll up and let down window shade, one end of which is joined to the fixed rail, another end of which is joined to a horizontal lifting rod;

an opposing fixed rail, which is parallel to the fixed rail and horizontally fixed to an upper edge of a window;

a take up and let down opposing unit, which is installed in an interior of the opposing fixed rail and linked to one end of a left linkage pull cord and one end of a right linkage pull cord, another end of the left linkage pull cord and another end of the right linkage pull cord are respectively joined to two ends of the horizontal lifting rod.

2. The curtain hanging assembly as described in claim 1, wherein a feedback torque produced by the roll up and let down feedback unit or the take up and let down opposing unit is a resulting torque provided with additional load.

3. The curtain hanging assembly as described in claim 1, wherein a torque producing component of the roll up and let down feedback unit or a torque producing component of the take up and let down opposing unit is respectively a helical spring or a volute spring functioning as a core component for torque stored energy and feedback.

4. The curtain hanging assembly as described in claim 1, wherein a torque producing component of the roll up and let down feedback unit or a torque producing component of the take up and let down opposing unit is an electric motor.

5. The curtain hanging assembly as described in claim 3, wherein an intensity of the torque produced by the volute spring is sequentially changeable.

6. The curtain hanging assembly as described in claim 1, wherein at least one initial torque value of the roll up and let down feedback unit is adjustable using a pressure regulation device.

7. The curtain hanging assembly as described in claim 1, wherein an elastic stress of the take up and let down opposing unit has an even force value.

8. A curtain hanging assembly, which provides a curtain assembly able to effect horizontal opening and closing of curtains, comprising:

a roll up and let down feedback unit, which horizontally rolls up and lets down a window shade, an end of the window shade is joined to a horizontal lifting rod;

a fixed rail, in which the roll up and let down feedback unit is installed;

a take up and let down opposing unit, linked to one end of a left linkage pull cord and one end of a right linkage pull cord, another end of the left linkage pull cord and another end of the right linkage pull cord are respectively joined to two ends of the horizontal lifting rod, wherein the two linkage pull cords are horizontally interconnected with a set of slatted blinds, one side of the slatted blinds is joined to a midsection of an opposing fixed rail, another side thereof is joined to the two ends of the horizontal lifting rod, the window shade and the slatted blinds are indirectly joined as a curtain assembly through the horizontal lifting rod;

the opposing fixed rail, which is parallel to the fixed rail and horizontally fixed to an upper edge of a window, in which the take up and let down opposing unit is installed.

9. The curtain hanging assembly as described in claim 8, wherein a feedback torque produced by the roll up and let down feedback unit or the take up and let down opposing unit is a resulting torque provided with additional load.

10. The curtain hanging assembly as described in claim 8, wherein a torque producing component of the roll up and let down feedback unit or a torque producing component of the take up and let down opposing unit is respectively a helical spring or a volute spring to function as a core component for torque stored energy and feedback.

11. The curtain hanging assembly as described in claim 8, wherein a torque producing component of the roll up and let down feedback unit or a torque producing component of the take up and let down opposing unit is an electric motor.

12. The curtain hanging assembly as described in claim 10, wherein an intensity of the torque produced by the volute spring is sequentially changeable.

13. The curtain hanging assembly as described in claim 8, wherein at least one initial torque value of the roll up and let down feedback unit is adjustable using a pressure regulation device.

14. The curtain hanging assembly as described in claim 10, wherein a feedback torque produced by the roll up and let down feedback unit or the take up and let down opposing unit is a resulting torque provided with additional load.

* * * * *